US008915563B2

(12) United States Patent
Kojima

(10) Patent No.: US 8,915,563 B2
(45) Date of Patent: Dec. 23, 2014

(54) LIQUID DROPLET EJECTING APPARATUS AND LIQUID DROPLET EJECTING METHOD

(75) Inventor: Kenji Kojima, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 13/445,182

(22) Filed: Apr. 12, 2012

(65) Prior Publication Data

US 2012/0268510 A1 Oct. 25, 2012

(30) Foreign Application Priority Data

Apr. 19, 2011 (JP) ..... 2011-092744

(51) Int. Cl.
*B41J 29/393* (2006.01)
*B41J 2/165* (2006.01)

(52) U.S. Cl.
CPC ..... *B41J 2/16579* (2013.01)
USPC ..... 347/9; 347/19

(58) Field of Classification Search
CPC ..... B41J 29/38; B41J 29/393
USPC ..... 347/9, 14, 19, 4, 37
See application file for complete search history.

(56) References Cited

U.S. PATENT DOCUMENTS

| | | | | |
|---|---|---|---|---|
| 7,374,270 | B2 | 5/2008 | Kojima | |
| 2008/0088662 | A1* | 4/2008 | Kojima | 347/19 |
| 2008/0088663 | A1* | 4/2008 | Kojima | 347/19 |
| 2009/0066743 | A1* | 3/2009 | Komatsu et al. | 347/14 |
| 2009/0066746 | A1* | 3/2009 | Sakai | 347/20 |
| 2009/0102876 | A1* | 4/2009 | Ooshiro et al. | 347/14 |
| 2009/0174887 | A1* | 7/2009 | Arazaki | 358/1.9 |
| 2009/0244164 | A1* | 10/2009 | Nakamaki et al. | 347/19 |
| 2010/0165035 | A1* | 7/2010 | Komatsu | 347/19 |
| 2010/0238229 | A1* | 9/2010 | Ito | 347/19 |
| 2010/0247743 | A1* | 9/2010 | Komori et al. | 427/8 |
| 2011/0216141 | A1* | 9/2011 | Kojima | 347/104 |

FOREIGN PATENT DOCUMENTS

| | | | |
|---|---|---|---|
| JP | 2001-044601 | A | 2/2001 |
| JP | 2003-251243 | A | 9/2003 |
| JP | 2006-076067 | A | 3/2006 |
| JP | 2008-225348 | A | 9/2008 |
| JP | 2009-255086 | A | 11/2009 |
| JP | 2009-274068 | A | 11/2009 |
| JP | 2010-023459 | A | 2/2010 |
| JP | 2010-046944 | A | 3/2010 |

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

An inspection ejection unit is moved, and ink that has been ejected onto the inspection ejection unit is imaged in a region outside of a movable range of an ejecting head, whereby the ink ejecting state of the nozzle is inspected.

13 Claims, 10 Drawing Sheets

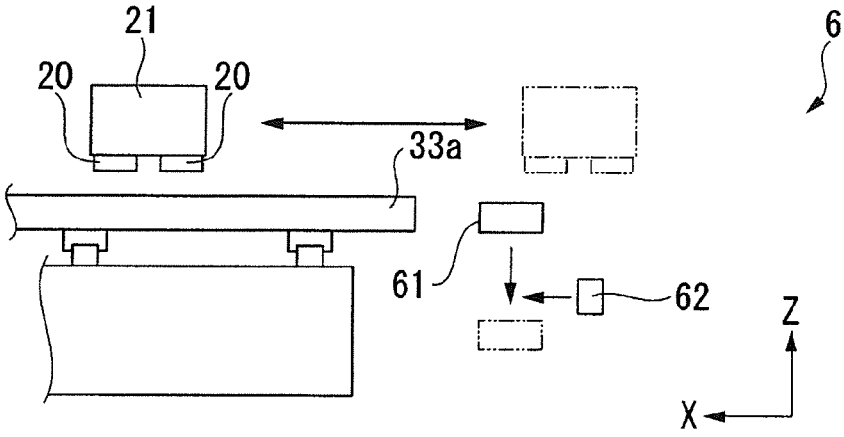
Fig. 9
Fig. 10A
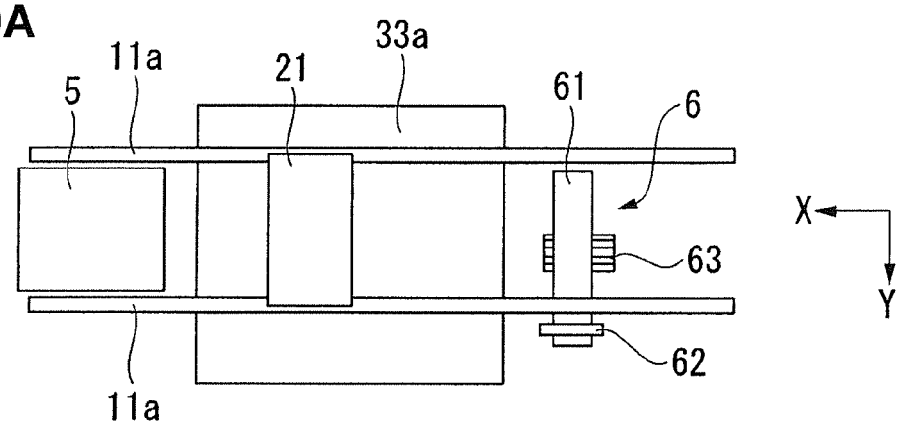
Fig. 10B
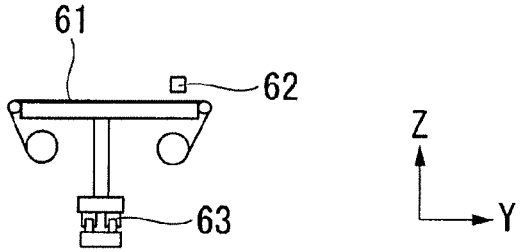

Fig. 11A
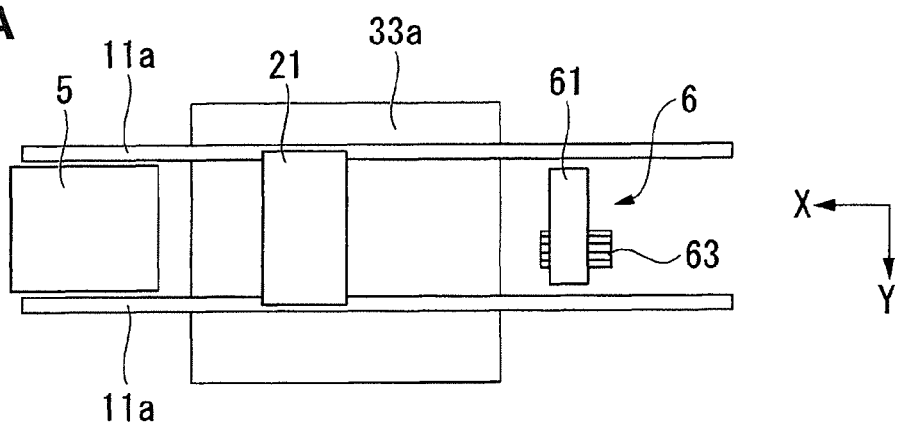
Fig. 11B
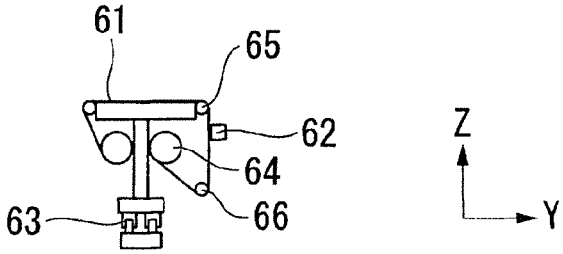
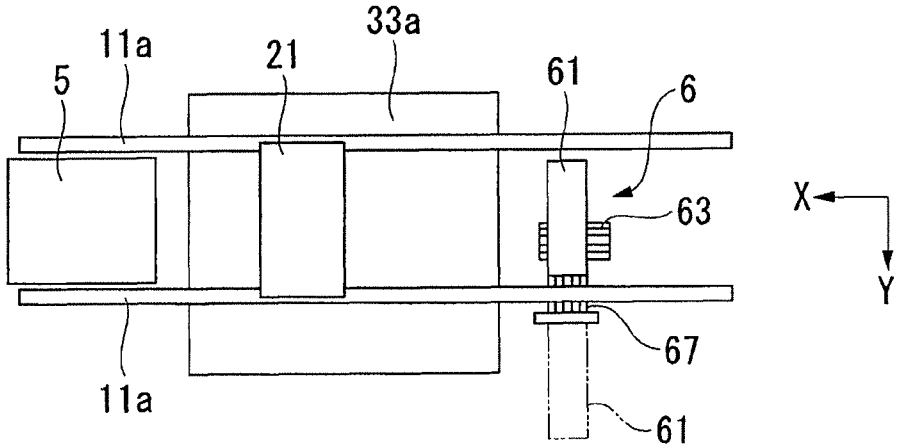
Fig. 12

LIQUID DROPLET EJECTING APPARATUS AND LIQUID DROPLET EJECTING METHOD

CROSS-REFERENCE TO RELATED APPLICATIONS

This application claims priority to Japanese Patent Application No. 2011-092744 filed on Apr. 19, 2011. The entire disclosure of Japanese Patent Application No. 2011-092744 is hereby incorporated herein by reference.

BACKGROUND

1. Technical Field

The present invention relates to a liquid droplet ejecting apparatus and a liquid droplet ejecting method.

2. Related Art

A liquid droplet ejecting apparatus is equipped with an ejecting head in which ink-ejecting nozzles have been formed. By causing the ejecting head and a target object to move relative to one another, ink is ejected and arranged on the target object in a wide range.

An inspection unit is installed in a liquid droplet ejecting apparatus of such description to inspect the ink ejecting state of the nozzles, for example, as shown in Japanese Laid-Open Patent Application No. 2006-76067 and Japanese Laid-Open Patent Application No. 2009-255086.

In a case in which the inspection unit of a liquid droplet ejecting apparatus has detected an abnormal ink ejecting state of the nozzles, the ink ejecting state of the nozzles is restored by cleaning of the nozzles and the like.

SUMMARY

However, in the above mentioned publications, the inspection unit performs an inspection in the region in which the ejecting head moves while drawing.

More specifically, in the above mentioned publications, an inspection ejection unit is arranged below the movable range of the ejecting head, an inspection camera is moved and an inspection pattern ejected onto the inspection ejection unit is imaged, and the ink ejecting state is determined on the basis of the imaging data.

In other words, in the above mentioned publications, the inspection camera moves above the inspection ejection unit within the movable range of the ejecting head, and the ejecting of ink onto the target object and the inspection of the nozzle ejecting state are performed simultaneously.

For this reason, in the above mentioned publications, there is a waiting period in which ink cannot be ejected onto the target object while the nozzle ejecting states are being inspected to maintain good nozzle ejecting states, and printing speed has to be sacrificed for improved printing quality.

In view of the problem described above, an object of the present invention is to provide a liquid droplet ejecting apparatus and a liquid droplet ejecting method able to improve printing quality while preventing a decrease in printing speed.

In the present invention, the following aspects have been adopted as means for solving this problem.

A liquid droplet ejecting apparatus according to a first aspect of the present invention includes an ejecting head and an inspection unit. The ejecting head has a nozzle that ejects ink onto a target object, the ejecting head being configured and arranged to move relative to the target object. The inspection unit is configured and arranged to inspect an ink ejecting state of the nozzle. The inspection unit includes an inspection ejection unit and an imaging unit. The inspection ejection unit is a unit onto which the ink is ejected from the nozzle of the ejecting head, the inspection ejection unit being movable. The imaging unit is arranged in a region outside of a movable range of the ejecting head. The imaging unit is configured and arranged to image the ink ejected onto the inspection ejection unit in the region outside of the movable range of the ejecting head.

According to the aspect of the invention as described above, the imaging unit is arranged outside of the movable range of the ejecting head, and the inspection ejection unit has also been configured so as to be movable.

As a result, the inspection ejection unit can be moved and the ejected ink can be imaged by the imaging unit after ink has been ejected onto the inspection ejection unit beneath the ejecting head. This does not require that the imaging unit be moved in the movable range of the ejecting head.

Therefore, according to the aspect of the invention as described above, the ejecting head can move while the nozzle ejecting state is being inspected, and the ejecting of ink onto the target object and the inspection of the nozzle ejecting state can be performed concurrently.

Thus, according to the aspect of the invention as described above, printing quality can be improved while printing speed is prevented from decreasing.

A second aspect of the present invention is the first aspect of the present invention in which the inspection ejection unit is preferably configured and arranged to move horizontally, and the imaging unit is fixed.

According to the aspect of the invention as described above, the imaging unit can perform imaging merely through the inspection ejection unit moving in the horizontal direction.

In other words, the inspection ejection unit can be moved along a single axis, and the moving mechanism for the inspection unit can be simplified.

A third aspect of the present invention is the first aspect of the present invention in which the inspection ejection unit is preferably configured and arranged to move at least vertically, and one of the inspection ejection unit and the imaging unit is preferably configured and arranged to move horizontally.

According to the aspect of the invention as described above, the imaging unit can be shifted in the vertical direction and arranged outside of the movable range of the ejecting head.

As a result, printing quality can be improved while preventing a decrease in printing speed and without increasing the size of the liquid droplet ejecting apparatus as viewed from above.

A fourth aspect of the present invention is any one of the first through third aspects in which a control is preferably performed to eject the ink from the nozzle onto the target object while the ejecting head repeatedly moves forward and backward in a main scanning direction, and to eject the ink from the nozzle onto the inspection ejection unit during a first forward movement.

According to the aspect of the invention as described above, the ink ejecting state can be inspected according to the quickest timing upon the printing of a single printed pattern.

Therefore, in a case in which there is an abnormality in the ink ejecting state, the ejecting of ink onto the target material can be stopped according to the quickest timing, and the amount of ink consumed can be reduced.

A fifth aspect of the present invention is any one of the first through third aspects in which a control is preferably performed to eject the ink from the nozzle onto the target object while the ejecting head repeatedly moves forward and backward in a main scanning direction, and to eject the ink from the nozzle onto the inspection ejection unit during consecutive forward and backward movements.

According to the aspect of the invention as described above, ink is ejected twice onto the inspection ejection unit so that the ink ejecting state of a single nozzle can be determined from ink ejected in two locations.

Therefore, false detection of ink ejecting states caused, for example, by foreign matter adhering to the inspection ejection unit can be suppressed, and accurate detection of the ink ejecting states can be realized.

A sixth aspect of the present invention is any one of the first through third aspects in which a control is preferably performed to eject the ink from the nozzle onto the target object while the ejecting head repeatedly moves forward and backward in a main scanning direction, and to eject the ink from the nozzle onto the inspection ejection unit during a plurality of forward and backward movements.

According to the aspect of the invention as described above, ink is ejected a plurality of times onto the inspection ejection unit so that the ink ejecting state of a single nozzle can be determined from ink ejected in a plurality of locations.

Therefore, false detection of ink ejecting states caused, for example, by foreign matter adhering to the inspection ejection unit can be suppressed, and accurate detection of the ink ejecting states can be realized.

A seventh aspect of the present invention preferably further includes a feed/discharge mechanism configured and arranged to transport the target object in a feed direction of the target object. When a second drawing pattern has been formed on the target object after the target object has been transported in the feed direction of the target object using the feed/discharge mechanism after a first drawing pattern has been formed on the target object, a control is preferably performed to eject the ink from the nozzle onto the inspection ejection unit during one of forward and backward movements of the ejecting head, which is repeatedly moved forward and backward in a main scanning direction to form the first drawing pattern on the target object, so as to complete inspection before formation of the second drawing pattern begins.

According to the aspect of the invention as described above, the ink ejecting state can be inspected before a second drawing pattern is formed, and the printing quality of the second drawing pattern can be improved.

An eighth aspect of the present invention is any one of the first through seventh aspects preferably including a marking unit configured and arranged to, when an abnormality in the ink ejecting state of the nozzle has been detected by the inspection unit, create a mark indicating a region to which the ink is ejected from the nozzle that has been detected as abnormal.

According to the aspect of the invention as described above, the region in which ink is ejected from a nozzle having a detected abnormal ink ejecting state is marked. A region in which the possibility of failure is high later in the process can be known in advance, and the inspection, for example, can be focused on this region. As a result, printing quality can be more accurately determined.

A ninth aspect of the present invention is any one of the first through eighth aspects, wherein, when an abnormality in the ink ejecting state of the nozzle has been detected by the inspection unit, a control is preferably performed to clean the nozzle after a pattern drawn by ejecting the ink has finished being drawn.

According to the aspect of the invention as described above, ink can be ejected onto the target object until the drawing of a pattern drawn according to the timing has been completed, even in a case in which an abnormal nozzle ejecting state has been detected.

There is a possibility that an abnormal nozzle ejecting state will not lead to deterioration in printing quality within an allowable limit. Thus, according to the aspect of the invention as described above, the possibility that a pattern unnecessarily will be determined to be poor is reduced. As a result, improved yield may be realized.

A tenth aspect of the present invention is any one of the first through ninth aspects wherein, when an abnormality in the ink ejecting state of the nozzle has been detected by the inspection unit, a control is preferably performed to confirm a usage frequency of the nozzle that has been detected as abnormal and to decide a start timing for cleaning the nozzle in accordance with the usage frequency.

According to the aspect of the invention as described above, the start timing for cleaning can be delayed due to the usage frequency of a nozzle detected to be abnormal, even when an abnormal ink ejecting state has been detected.

When the usage frequency of a nozzle detected to be abnormal is very low, the impact of the nozzle on the product quality of a pattern drawn on a target material may be negligible. In these cases, according to the aspect of the present invention described above, the start timing of the cleaning process can be delayed, whereby the incidence of waiting time can be minimized, and printing speed can be improved.

An eleventh aspect of the present invention is any one of the first through tenth aspects in which a length of the imaging unit is preferably shorter than a length of a head unit to which a plurality of the ejecting heads are provided.

According to the aspect of the invention as described above, since the inspection ejection unit is able to move, ink ejected from the entire range of ejecting heads can be imaged by moving the inspection ejection unit, even when the length of the imaging unit is less than that a head unit.

As a result, according to the aspect of the invention as described above, the length of the imaging unit can be shorter than an ejecting head unit, and the cost of the device can be reduced.

A twelfth aspect of the present invention is any one of the first through eleventh aspects wherein a control is preferably performed so that, each time the ink is ejected from the nozzle, a position of the inspection ejection unit below the ejecting head is displaced.

An accurate inspection cannot be performed when subsequently ejected ink overlaps with previously ejected ink on the inspection ejection unit; therefore, subsequently ejected ink has to be ejected into a different region than previously ejected ink. Therefore, either the position in which the inspection ejection unit is arranged has to be displaced, or the bit map data indicating the ejecting position has to be changed. However, bit map data is not easy to change. Either multiple sets of bit map data have to be provided, or new bit map data has to be generated when needed. This increases the operating costs of the device.

Because the position of the inspection ejection unit is displaced according to the aspect of the invention as described above, the bit map data does not have to be changed. This prevents an increase in the operating costs of the device.

A liquid droplet ejecting method according to a thirteen aspect of the present invention is a method for ejecting ink onto a target object from a nozzle formed in an ejecting head that is movable relative to the target object. The liquid droplet ejecting method includes: ejecting the ink onto an inspection ejection unit from the nozzle in the ejecting head; moving the inspection ejection unit; and imaging the ink ejected onto the inspection ejection unit in a region outside of a movable range of the ejecting head to inspect the ink ejecting state of the nozzle.

According to the aspect of the invention as described above, the inspection ejection unit is moved after ink has been ejected onto the inspection ejection unit beneath the ejecting head, and the ejected ink is imaged by the imaging unit. As a result, the imaging unit does not have to move in the movable range of the ejecting head.

Therefore, according to the aspect of the invention as described above, the ejecting head can move while the nozzle ejecting state is being inspected, and the ejecting of ink onto the target object and the inspection of the nozzle ejecting state can be performed concurrently.

Thus, the invention according to the aspect as described above is able to improve printing quality while preventing a decrease in printing speed.

BRIEF DESCRIPTION OF THE DRAWINGS

Referring now to the attached drawings which form a part of this original disclosure:

FIG. 9 is a schematic view of a modification of the liquid droplet ejecting apparatus in the first embodiment of the present invention;

FIG. 10 is a schematic view of a modification of the liquid droplet ejecting apparatus in the first embodiment of the present invention;

FIG. 11 is a schematic view of a modification of the liquid droplet ejecting apparatus in the first embodiment of the present invention;

FIG. 12 is a schematic view of a modification of the liquid droplet ejecting apparatus in the first embodiment of the present invention;

DETAILED DESCRIPTION OF EXEMPLARY EMBODIMENTS

Figure 1A:
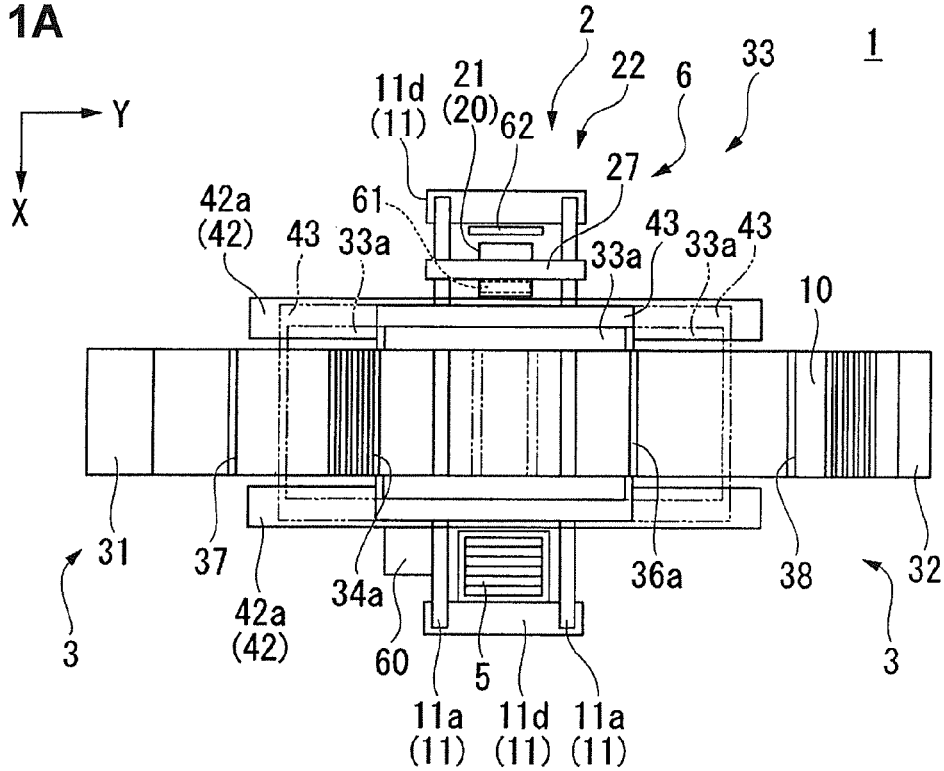
FIG. 1 is a schematic view illustrating the configuration of the liquid droplet ejecting apparatus in the first embodiment of the present invention, in which A is a top view of the liquid droplet ejecting apparatus, and B is a side view of the liquid droplet ejecting apparatus.

There follows a description, with reference to the accompanying drawings, of embodiments of the liquid droplet ejecting apparatus and liquid droplet ejecting method of the present invention. In the drawings, the scale of each component has been changed where appropriate so that each of the components is large enough to be recognizable.

Figure 1B:
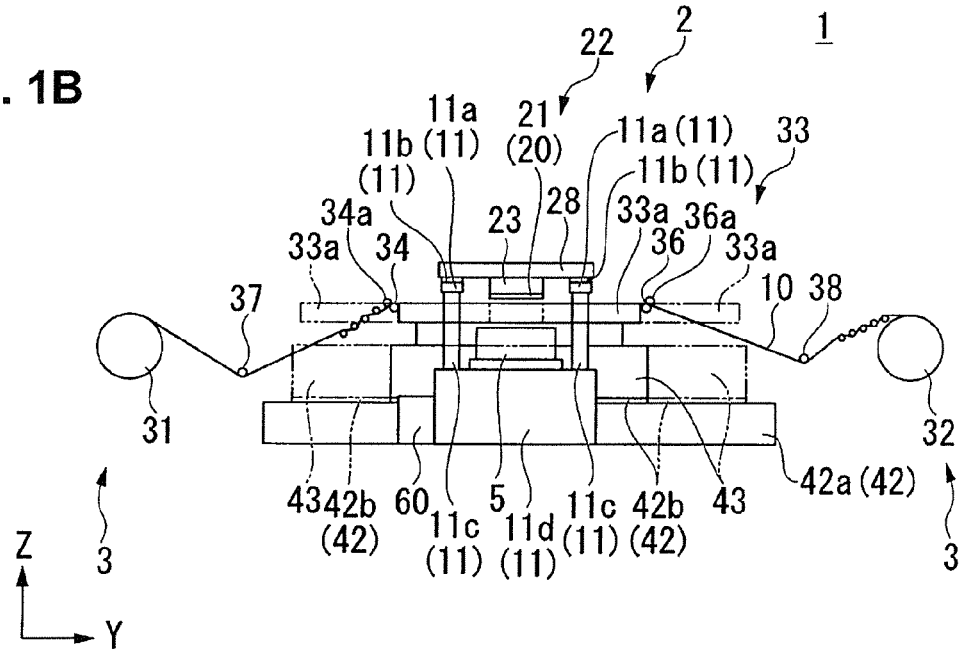

FIGS. 1A and 1B are schematic views illustrating the configuration of the liquid droplet ejecting apparatus in the first embodiment of the present invention, in which A is a top view of the liquid droplet ejecting apparatus, and B is a side view of the liquid droplet ejecting apparatus. FIG. 1A and FIG. 1B show a case where the liquid droplet ejecting apparatus of the present invention is used in a printing apparatus for printing a continuous long recording medium 10 (target object). In FIG. 1A and FIG. 1B, 1 denotes the liquid droplet ejecting apparatus; the liquid droplet ejecting apparatus 1 includes an ejecting head 20 for ejecting ultraviolet-cured ink as the ink, and an irradiation device 80 for irradiating the ultraviolet-cured ink ejected from the ejecting head 20 with ultraviolet light (see FIG. 4).

The liquid droplet ejecting apparatus 1 in the present embodiment also includes a head mechanism 2 having an ejecting head 20, a feed/discharge mechanism 3, an ink supplying unit (not shown), a maintenance unit 5, an inspection unit 6, and a control unit 60.

The ejecting head 20 is an inkjet-type ejecting head for ejecting an ink containing a component having ultraviolet curing properties, or an ultraviolet-cured ink, as droplets towards a recording surface of a long, continuous, belt-like recording medium 10. In the present embodiment, the recording medium 10 is a medium allowing for recording with an ultraviolet-cured ink. More specifically, a flexible film made of polyethylene terephthalate (PET), polyethylene (PE), polycarbonate (PC), or polypropylene (PP) is used.

The feed/discharge mechanism 3 feeds (conveys) the recording medium 10 to the recording position with the ejecting head 20, and discharges (conveys) the recording medium from the recording position. The ink supplying unit supplies ink stored in a storage tank (not shown) to the ejecting head 20. The maintenance unit 5 maintains the ejecting head 20. In the present embodiment, the ejecting head 20 is cleaned to restore the nozzle ejecting state.

The feed/discharge mechanism 3 includes a supply reel 31, a take-up reel 32, a vacuum-chucking unit 33, an idler roller 37, another idler roller 38, and a Y-axis scanning mechanism 42.

The Y-axis scanning mechanism 42 includes two pairs of Y-axis guide rails 42*a*, and Y-axis sliders 42*b*. The vacuum-chucking unit 33 includes a vacuum-chucking table 33*a*, a table platform 43, a table elevating mechanism, a supply roller 34, a driven roller 34*a*, a medium feed roller 36, and a driven roller 36*a*. Each reel and roller is able to rotate around its own axis of rotation, and each of the axes of rotation is substantially parallel to the others.

The direction in which the recording medium 10 is set is substantially perpendicular to the substantially parallel axes of rotation of the reels and rollers. The direction parallel to the axial direction of the axes of rotation of the reels and rollers is the X-axis direction, and the direction in which the recording medium 10 is sent is the Y-axis direction.

A Y-axis guide rail 42*a* of the Y-axis scanning mechanism 42 is arranged on both sides of vacuum-chucking table 33*a* in the X-axis direction, and extends in the Y-axis direction. The Y-axis slider 42*b* is provided in the bottom surface of the table platform 43 and is arranged above the Y-axis guide rails 42*a* in this state so as to be capable of sliding in the extending direction along the Y-axis guide rails 42*a* using a Y-axis drive motor (not shown).

The vacuum-chucking table 33*a* of the vacuum-chucking unit 33 is fixed to the table elevating mechanism fixed on top of the table platform 43. The vacuum-chucking table 33*a* holds the recording medium 10 on its upper surface. Therefore, the upper surface, which is the side holding the recording medium 10, is the holding surface. In this configuration, ultraviolet-curable ink is ejected from the ejecting head 20 while the recording medium 10 is being held on the holding surface so that droplets of ink land on the recording medium 10.

A vacuum-chucking recess composed of a vacuum-chucking hole or a vacuum-chucking groove (not shown) connected to a negative pressure source (not shown) is provided in the vacuum-chucking table 33*a*, and the vacuum-chucking recess opens into the holding surface. By suctioning and chucking the recording medium 10 using the vacuum-chucking recess connected to the negative pressure source while the recording medium is positioned in a predetermined location on top of the holding surface, the recording medium can be held and secured on top of the holding surface.

Because the table elevating mechanism elevates the vacuum-chucking table 33*a* in the Z-axis direction, the holding surface (vacuum-chucking surface) of the vacuum-chucking table 33*a* is raised and lowered between the vacuum-chucking position, which is a predetermined position in the Z-axis direction, and a retracted position closer to the table platform 43 than the vacuum-chucking position, and is held and secured in each position. The position of the holding surface of the vacuum-chucking table 33*a* when in the vacuum-chucking position substantially matches the upper end positions of the outer periphery of the supply roller 34 described below and the outer periphery of the medium feed roller 36. Here, the Z-axis direction indicates the normal direction for the holding surface of the vacuum-chucking table 33*a*.

The supply roller 34, the driven roller 34*a*, the medium feed roller 36, and the driven roller 36*a* are arranged on both sides of the vacuum-chucking table 33*a* in the Y-axis direction. The supply rollers 34, driven rollers 34*a*, medium feed rollers 36, and driven rollers 36*a* are fixed to the table platform 43 via support components (not shown). In this state, the vacuum-chucking table 33*a* is arranged therebetween. The supply rollers 34 and the driven rollers 34*a* are arranged upstream from the vacuum-chucking table 33*a* on the supply reel 31 side, and the medium feed rollers 36 and the driven rollers 36*a* are arranged downstream from the vacuum-chucking table 33*a* on the take-up reel 32 side.

The table platform 43 can be moved in the Y-axis direction by the Y-axis scanning mechanism 42, and can be held in any position in the Y-axis direction. The vacuum-chucking table 33*a*, the supply rollers 34, the driven rollers 34*a*, the medium feed rollers 36, and the driven rollers 36*a* arranged on top of the table platform 43 can also be moved in the Y-axis direction by the Y-axis scanning mechanism 42, and can be held in any position in the Y-axis direction.

The supply reel 31, idler roller 37, vacuum-chucking unit 33, idler roller 38, and take-up reel 32 in the feed/discharge mechanism 3 are arranged in the stated order in the Y-axis direction, which is the feed direction for the recording medium 10. The supply reel 31 side is upstream and the take-up reel 32 side is downstream in the feed direction of the recording medium 10.

Also, in the vacuum-chucking unit 33, the supply roller 34, the driven roller 34*a*, the vacuum-chucking table 33*a*, the medium feed roller 36, and the driven roller 36*a* are arranged in order in the Y-axis direction. Therefore, in the feed/discharge mechanism 3, the supply reel 31, idler roller 37, supply roller 34, driven roller 34*a*, vacuum-chucking table 33*a*, medium feed roller 36, driven roller 36*a*, idler roller 38, and take-up reel 32 are arranged in order in the Y-axis direction.

The belt-like recording medium 10 is wound around the supply reel 31. The recording medium 10 is run out as the supply reel 31 is caused to rotate by the supply motor (not shown). The driven roller 34*a* is arranged so the outer periphery makes contact with the outer periphery of the supply roller 34, and is pressed against the supply roller 34 by a biasing device (not shown). The supply roller 34 is rotated by the supply motor (not shown), and the driven roller 34*a* making direct or indirect contact with the supply roller 34 is driven and rotated by the rotation of the supply roller 34. The recording medium 10, which is interposed between the supply roller 34 and the driven roller 34*a* in this configuration, is fed by the rotation of the supply roller 34.

The idler roller 37 has a rotational axis that can swing in the Z-axis direction, and the idler roller is biased towards one side in the swinging direction (downward in the present embodiment). Also, the biasing force causes the idler roller 37 to make contact with the supply reel 31 and a portion between the supply roller 34 and the driven roller 34*a*. Because the recording medium 10 is biased by the idler roller 37 in this configuration, it is stretched without slack between the supply reel 31 and the idler roller 37, and between the idler roller 37, the supply roller 34, and the driven roller 34*a*.

As a result, the recording medium 10 is easy to keep substantially flat when supplied and interposed between the supply roller 34 and the driven roller 34*a*. The difference in the supply speed of the recording medium 10 by the supply roller 34 and the run out speed of the recording medium 10 by the supply reel 31 changes the amount of slack between the supply reel 31, the supply roller 34, and the driven roller 34*a*. Because the position of the idler roller 37 changes as the amount of slack changes, the recording medium remains stretched without slack. Similarly, the recording medium remains stretched without slack even when the amount of slack in the recording medium 10 changes between the supply reel 31, the supply roller 34, and the driven roller 34*a* due to movement of the vacuum-chucking unit 33.

The driven roller 36*a* is arranged so its outer periphery makes contact with the outer periphery of the supply roller 36, and is pressed against the medium feed roller 36 by a biasing device (not shown). The medium feed roller 36 is rotated by a medium feed motor (not shown), and the driven roller 36*a* making direct or indirect contact with the medium feed roller 36 is driven and rotated by the rotation of the medium feed roller 36. The recording medium 10, which is interposed between the medium feed roller 36 and the driven roller 36*a* in this configuration, is fed by the rotation of the medium feed roller 36.

Here, the feed amount by the medium feed roller 36 is greater than the feed amount by the supply roller 34. A torque control mechanism (not shown) is incorporated into the power transmission mechanism from the medium feed motor to the medium feed roller 36. In a medium feed roller 36 having this configuration, the recording medium 10 being fed quickly by the supply roller 34 remains stretched between the supply roller 34 and the medium feed roller 36 by tension according to the torque controlled by the torque control mechanism.

The holding surface of the vacuum-chucking table 33*a* faces the portion under tension. In other words, the portion of the recording medium 10 positioned on the holding surface of the vacuum-chucking table 33*a* is stretched by tension according to the torque controlled by the torque control mechanism. Here, the position of the holding surface of the vacuum-chucking table 33*a* positioned in the vacuum-chucking position mentioned above substantially matches the position of the surface formed by the upper end of the outer periphery of the medium feed roller 36 and the upper end of the outer periphery of the supply roller 34. Therefore, the holding surface of the vacuum-chucking table 33*a* positioned in the vacuum-chucking position makes contact with the recording medium 10 stretched between the supply roller 34 and the medium feed roller 36 and holds the recording medium.

The vacuum-chucking table 33*a* holds the recording medium 10 on the holding surface. The holding surface is a flat surface, and the holding surface holds the recording medium 10 so that the held surface, which is the surface opposite the recorded surface, is held in a flat state. Also, while not shown in the drawing, the holding surface is provided with a vacuum-chucking recess composed of a vacuum-chucking hole or a vacuum-chucking groove. The held surface of the recording medium 10 is chucked by the vacuum-chucking recess, so that the recording medium is chucked and held on the holding surface of the vacuum-chucking table 33*a*. In other words, a negative pressure source not shown in the drawing such as a suction pump is connected to the vacuum-chucking groove via piping, etc., so that the vacuum-chucking recess chucks the recording medium 10 positioned over the opening.

The take-up reel 32 is rotated by a winding motor (not shown), and the recording medium 10 fed from the medium feed roller 36 is wound on the take-up reel 32.

The idler roller 38 has a rotational axis that can swing in the Z-axis direction, and the idler roller 38 is biased towards one side in the swinging direction. Also, the biasing force causes the idler roller 38 to make contact with the recording medium 10 in the portion between the medium feed roller 36, the driven roller 36*a*, and the take-up reel 31. Being biased by the idler roller 38 in this configuration, the recording medium 10 is stretched without slack between the medium feed roller 36, the driven roller 36*a*, and the take-up reel 31, and between the idler roller 38 and the take-up reel 32.

As a result, the recording medium 10 is easy to keep substantially flat when wound by the take-up reel 32. The difference in the supply speed of the recording medium 10 by the medium feed roller 36 and the winding speed of the recording medium 10 by the take-up reel 32 changes the amount of slack between the medium feed roller 36 and the take-up reel 32. However, because the position of the idler roller 38 changes as the amount of slack changes, the recording medium remains stretched without slack. Similarly, the recording medium remains stretched without slack even when the amount of slack in the recording medium 10 changes between the medium feed roller 36 and the winding roller 32 due to movement of the vacuum-chucking unit 33.

In this state, the recording medium 10 is fed from the supply reel 31 to the take-up reel 32, and recording (printing) is performed in transit on the portion held on the holding surface of the vacuum-chucking table (medium holding unit) 33*a*.

The head mechanism 2 has a head carriage 22 and an X-axis scanning mechanism 11.

The X-axis scanning mechanism 11 includes two pairs of X-axis guide rails 11*a*, X-axis sliders 11*b*, and support platforms 11*d*. It also includes four guide rail support columns 11*c*. A support platform 11*d* is arranged on both sides of the vacuum-chucking table 33*a* in the X-axis direction of the vacuum-chucking table 33*a*. The support platforms are also arranged so as to flank the pair of Y-axis guide rails 42*a*, 42*a* described above. A maintenance unit 5 is arranged between one of the Y-axis guide rails 42*a* and one of the support platforms 11*d*.

Two guide rail support columns 11*c* are erected above the two support platforms 11*d*, 11*d* so that there is one guide rail support column 11*c* on both ends in the Y-axis direction. One of the two X-axis guide rails 11*a* bridges the guide rails columns 11*c* erected on the supply reel 31 side of the support platform 11*d*, and is arranged so as to extend in the X-axis direction above the vacuum-chucking table 33*a*. The other one of the two X-axis guide rails 11*a* bridges the guide rail columns 11*c* erected on the take-up reel 32 side of the support platform 11*d*, and is arranged so as to extend in the X-axis direction above the vacuum-chucking table 33*a*.

Because X-axis sliders 11*b* are arranged above the X-axis guide rails 11*a*, the X-axis drive motor (not shown) can slide above the X-axis guide rails 11*a* in the direction of extension. Both ends of a bridge plate 27 for a head bridge 22 are fixed to the X-axis sliders 11*b* supported by two X-axis guide rails 11*a*. The bridge plate 27 fixed to X-axis sliders 11*b* on both ends bridges the two X-axis guide rails 11*a* while being supported by the X-axis sliders 11*b*. In this configuration, the X-axis drive motor slides the bridge plate 27 above the X-axis guide rails 11*a* in the direction of extension or holds them in a given position in the X-axis direction.

Figure 2A:
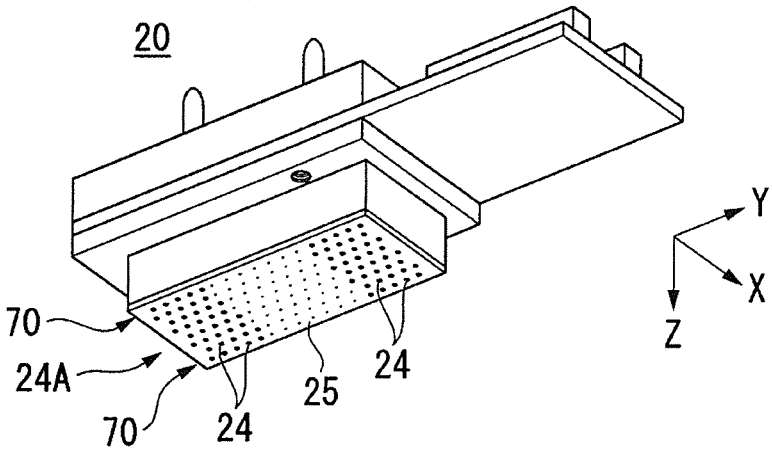
FIGS. 2A through 2C are views illustrating the configuration of an ejecting head.

The head bridge 22 includes a bridge plate 27, a subcarriage 28, and a head unit 21. The subcarriage 28 is provided near the center of the lower surface of the bridge plate 27, and the head unit 21 is fixed to the lower surface side of the subcarriage 28. An ejecting head 20 is provided on the bottom surface side of the head unit 21, and a nozzle substrate 25 in which nozzles 24 have been formed as shown in FIG. 2A is arranged on the bottom side of the ejecting head 20. In this configuration, the ejecting head 20 is positioned above the holding surface of the vacuum-chucking table 33*a*. At this time, the nozzle substrate 25 faces the holding surface.

Here, the vacuum-chucking unit 33 can be moved in the Y-axis direction by the Y-axis scanning mechanism 42 and, accordingly, the holding surface of the vacuum-chucking table 33*a* can be moved in the Y-axis direction. In other words, the portion of the recording medium 10 chucked and held on the vacuum-chucking table 33*a* can be scanned in the Y-axis direction.

Meanwhile, the X-axis scanning mechanism 11 moves the bridge plate 27 provided in the subcarriage 28 in the X-axis direction, and the ejecting head 20 of the head unit 21 fixed to the subcarriage 28 performs a scan in the X-axis direction.

In the present embodiment, an inspection unit 6 is arranged on the −X direction side of the vacuum-chucking table 33*a*. Also, in the X-axis scanning mechanism 11, the length of the X-axis guide rails 11*a* is set so that the ejecting head 20 can reach the inspection ejection unit 61 in the inspection unit 6 which is described below.

In this configuration, the X-axis scanning mechanism 11 allows the ejecting head 20 in the head unit 21 to scan in the X-axis direction, and the Y-axis scanning mechanism 42 allows the portion of the recording medium 10 chucked and held on the vacuum-chucking table 33*a* to scan in the Y-axis direction. In other words, the nozzles 24 in the ejecting head 20 can face the surface of the entire portion of the recording medium 10 chucked and held on the vacuum-chucking table 33*a*.

Thus, the recorded portion of the recording medium 10 chucked and held on the holding surface of the vacuum-chucking table 33*a* is moved and stopped at the ejecting position in the Y-axis direction, and caused to conform to the movement of the head unit 21 in the X-axis direction, and droplets of ultraviolet-curable ink are ejected from the ejecting head 20 to arrange droplets (dots) of ultraviolet-curable ink in the desired positions on the recording medium 10. Accordingly, the control unit 60, in the manner described below, controls the main scanning in which the head unit 21 moves in the X-axis direction, and subscanning (line feed) in which the recording medium 10 chucked and held on the holding surface, of the vacuum-chucking table 33*a* is moved in the Y-axis direction. In this way, the ejecting head 20 in the head unit 21 can be brought to the desired position facing the recording medium 10 held on the holding surface of the vacuum-chucking table 33*a*, and ultraviolet-curable ink can be ejected as liquid droplets in this state. Thus, the desired image can be formed (recorded) on the recording medium 10. In other words, in the present embodiment, the ejecting head 20 moves forward and backward repeatedly in the main scanning direction (X direction) while ultraviolet-curable ink is ejected onto the recording medium 10. Also, the recording medium 10 is line-fed in the subscanning direction each time the ejecting head 20 moves to either side (forward or backward). In this way, the desired image is formed on the recording medium 10.

Figure 2B:
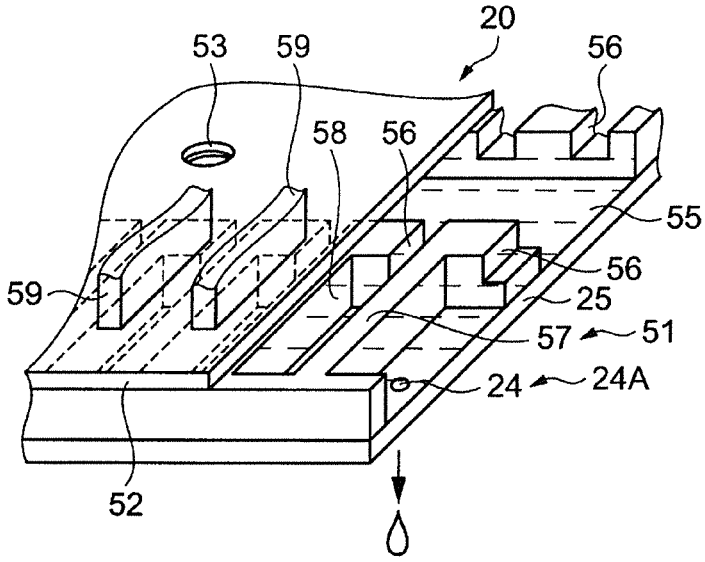
Figure 2C:
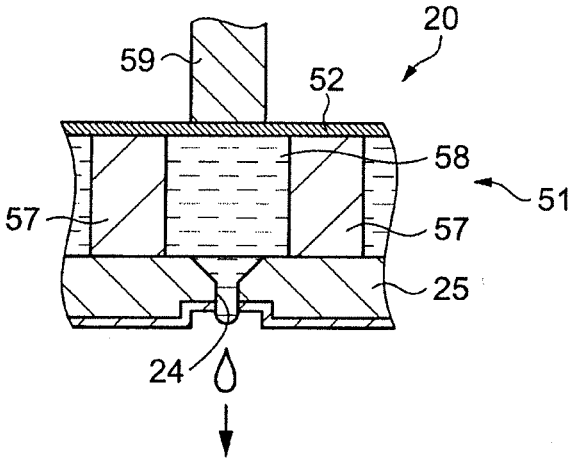
Figure 3:
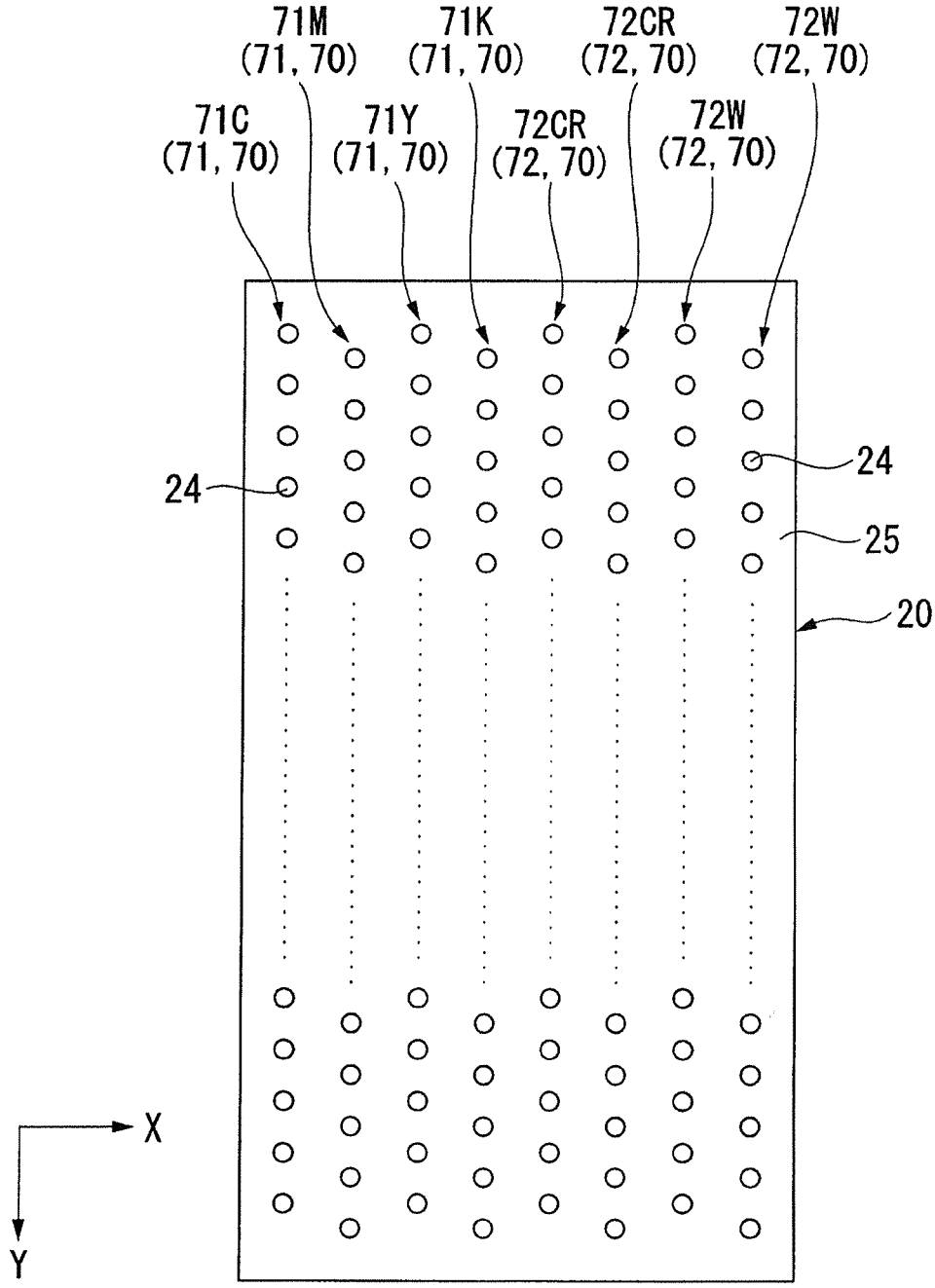
FIG. 3 is a top view illustrating the ejecting surface (bottom surface) of the ejecting head.

The following is an explanation of the ejecting head 20 with reference to FIG. 2A through FIG. 2C and FIG. 3. FIG. 2A through FIG. 2C are simplified views of the configuration of the ejecting head 20. FIG. 2A is a simplified external view of the configuration of the ejecting head 20, FIG. 2B is a simplified perspective view used to explain the internal structure of the ejecting head 20, and FIG. 2C is a simplified cross-sectional view showing the nozzle portion of the ejecting head 20. FIG. 3 is a top view showing the ejecting surface (bottom surface) of the ejecting head 20, which is used to explain the configuration of the nozzle columns. The X axis, Y axis, and (Z axis) in FIG. 2A and FIG. 3 matches the X axis, Y axis, and (Z axis) in FIG. 1A and FIG. 1B showing the incorporation of the ejecting head 20 in the liquid droplet ejecting apparatus 1.

The ejecting head 20 shown in FIG. 2A includes a nozzle substrate 25. In this nozzle substrate 25, a plurality of nozzle columns 70 are formed in the X-axis direction. In each one of these columns, multiple nozzles 24 are arranged in linear fashion in the Y-axis direction. In the present embodiment, as shown in FIG. 3, there are eight nozzle columns 70. The nozzle columns 70 in the present embodiment include first nozzle columns 71 and second nozzle columns 72. In a first nozzle column, nozzles are arranged for ejecting an image-forming ink containing a color material (that is, a color ink). In a second nozzle column, nozzles are arranged for ejecting an undercoat or overcoat ink (that is, a clear ink or a white ink not containing a color material).

More specifically, in FIG. 3, the first nozzle columns 71 include in sequential order from the left side one column each of a first nozzle column 71C for ejecting cyan (C) color ink, a first nozzle column 71M for ejecting magenta (M) color ink, a first nozzle column 71Y for ejecting yellow (Y) color ink, and a first nozzle column 71K for ejecting black (K) ink. The second nozzle columns 72 include two columns each of a second nozzle column 72CR for ejecting a clear ink for an undercoat, and a second nozzle column 72W for ejecting a white ink for an overcoat. In other words, in the present embodiment, the number of second columns 72CR, 72W is greater than the number of first nozzle columns 71C, 71M, 71Y, 71K for ejecting color ink.

Here, in FIG. 3, the odd-numbered nozzle columns from the left (that is, the 1st first nozzle column 71C, the 3rd first nozzle column 71Y, the 5th second nozzle column 72CR, and the 7th second nozzle column 72W) are arranged so that the positions of corresponding nozzles 24 are the same between each nozzle column in the Y-axis direction, and so that the interval between nozzles 24 is the same in the Y-axis direction. Therefore, each nozzle 24 in each nozzle column is arranged at an equal pitch. Similarly, in FIG. 3, the even-numbered nozzle columns from the left (that is, the 2nd first nozzle column 71M, the 4th first nozzle column 71K, the 6th second nozzle column 72CR, and the 8th second nozzle column 72W) are arranged so that the positions of corresponding nozzles 24 are the same between each nozzle column in the Y-axis direction, and so that the interval between nozzles 24 is the same in the Y-axis direction. Therefore, each nozzle 24 in each nozzle column is arranged at an equal pitch.

However, the intervals between two adjacent nozzle columns in the X-axis direction (for example, the interval between the first nozzle column 71C and the first nozzle column 71M, the interval between the first nozzle column 71Y and the first nozzle column 71K, the interval between two second nozzle columns 72CR, and the interval between two second nozzle columns 72W) are staggered so that the position of each nozzle 24 is shifted a half-pitch in the Y-axis direction.

In the present embodiment, each nozzle column 71, 72 is formed so that there is a total of 180 nozzles 24.

By ejecting ultraviolet-curable ink as droplets from these nozzles 24 so as to land on the surface of the opposing recording medium 10, the ejecting head 20 is able to arrange ultraviolet-curable ink in the desired locations on the recording medium 10.

In the ejecting head 20, as shown in FIG. 2B and FIG. 2C, a pressure chamber plate 51 is stacked on top of the nozzle substrate 25, and a diaphragm 52 is stacked on top of the pressure chamber plate 51. A liquid reservoir 55 is formed in the pressure chamber plate 51 which is always filled with ultraviolet-curable ink to be supplied to the ejecting head 20. The liquid reservoir 55 is a space enclosed by the diaphragm 52, the nozzle substrate 25, and walls (not shown). The ultraviolet-curable ink is supplied to the liquid reservoir 55 via a liquid-supply hole 53 in the diaphragm 52. A pressure chamber 58 is formed in the pressure chamber plate 51 partitioned by a plurality of head partitions 57.

The pressure chambers 58 are designed so as to correspond to each nozzle 24, so the number of pressure chambers 58 is the same as the number of nozzles 24. A functional liquid is supplied from a liquid reservoir 55 to a pressure chamber 58 via a supply opening 56 positioned between two head partitions 57. A group of pressure chambers 58 with head partitions 57 and supply openings 56 with nozzles 24 are arranged in a column along a liquid reservoir 55 so that the nozzles 24 in the column form a nozzle column 24A. Although omitted in FIG. 2B, another nozzle column 24A is formed next to this nozzle column 24A containing nozzles 24.

As shown in FIG. 2C, piezoelectric elements 59 corresponding to each of the pressure chambers 58, that is, corresponding to each of the nozzles 24, are arranged on top of the diaphragm 52. Because a piezoelectric element 59 is a piezoelectric layer interposed between a lower electrode and an upper electrode, ultraviolet-curable ink is ejected from the corresponding nozzle 24 when a drive waveform (drive voltage) is applied between the electrodes. Here, the piezoelectric element 59 is controlled by the control unit 60 shown in FIG. 1A and FIG. 1B.

Figure 4:
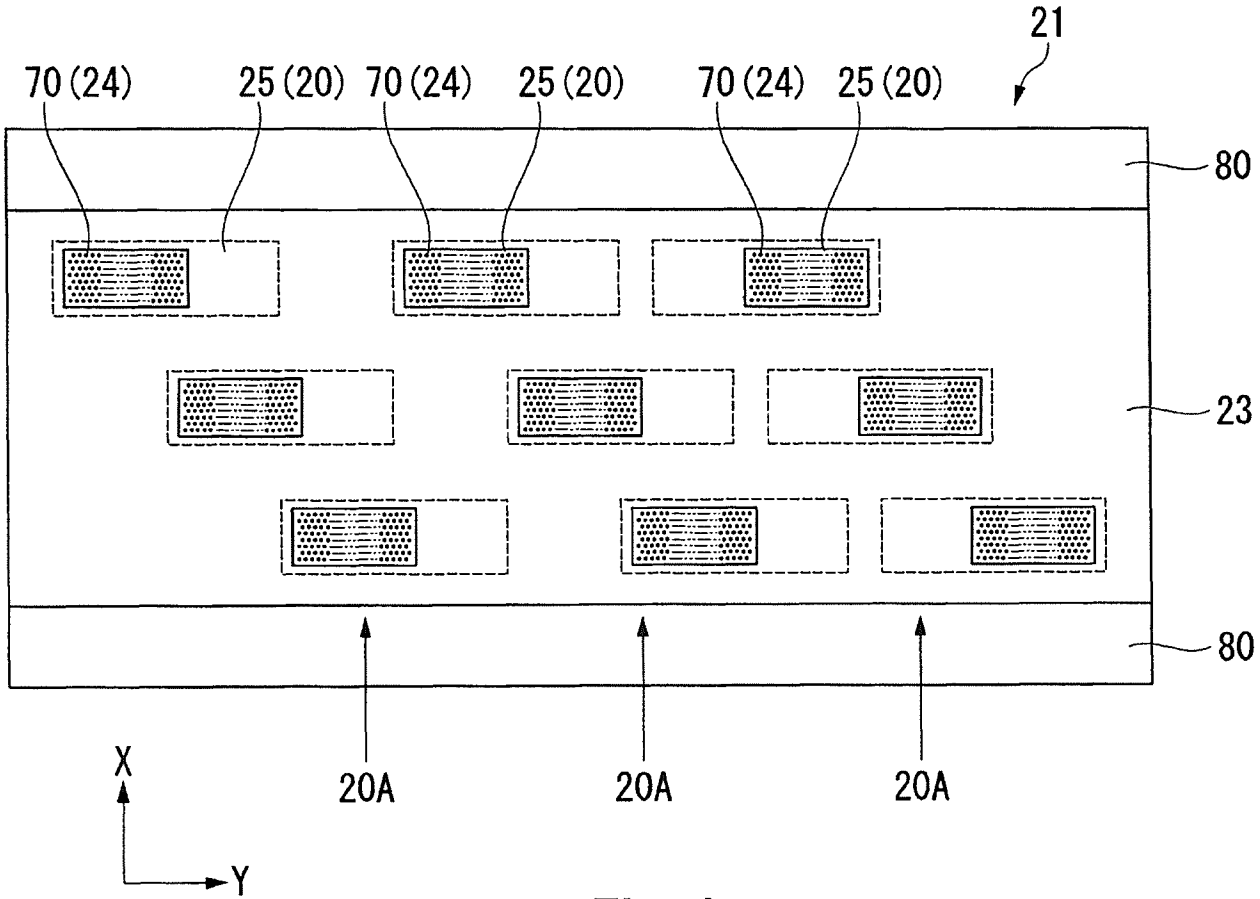
FIG. 4 is a bottom view illustrating a configuration of head units.

The following is an explanation with reference to FIG. 4 of the configuration of the head unit 21 in the head mechanism 2. FIG. 4 is a bottom view of the configuration of the head unit. The X axis and Y axis in FIG. 4 match the X axis and Y axis in FIG. 1.

As shown in FIG. 4, the head unit 21 includes a unit plate 23 attached to the bottom surface of the subcarriage 28, and nine ejecting heads 20 mounted on the bottom surface of the unit plate 23. Also, an irradiation device 80 for irradiating the recording medium with ultraviolet light is arranged on both ends of the nine ejecting heads 20 in the X-axis direction. There are nine ejecting heads 20 in FIG. 4, but the number of ejecting heads 20 is not limited to this. For example, 15 heads can be provided.

The ejecting head 20 is fixed to the unit plate 23 by a holding component (not shown) with the nozzle substrate 25 facing downward. Also, the nine ejecting heads 20 are divided up in the Y-axis direction to form three head groups 20A of three ejecting heads 20 each. The nozzle columns 24A in each ejecting head 20 are arranged in the Y-axis direction when the head unit 21 is attached to the liquid droplet ejecting apparatus 1.

The three ejecting heads 20 constituting a single head group 20A are arranged in the Y-axis direction so that the nozzle 24 at one end of the ejecting head 20 is shifted one nozzle pitch relative to the nozzle 24 at the other end of the ejecting head 20. In this configuration, the three ejecting heads 20 in a head group 20A are arranged so that all of the nozzles 24 have the same position in the X-axis direction, and so that all of the nozzles 24 are aligned at an equal pitch in the Y-axis direction. In other words, in droplets ejected from the nozzles 24 constituting the nozzle columns 24A in the ejecting heads 20 land by design in the same position along the X-axis direction and in a line at equal intervals in the Y-axis direction.

Also, the three head groups 20A in a head unit 21 are arranged so that all of the nozzles 24 have the same position in the X-axis direction, and so that all of the nozzles 24 are aligned at an equal pitch in the Y-axis direction. In other words, in droplets ejected from the nozzles 24 constituting the nozzle columns 24A in the ejecting heads 20 land by design in the same position along the X-axis direction and in a line at equal intervals in the Y-axis direction. Thus, the 18 nozzle columns 24A in the nine ejecting heads 20 of the three head groups 20A in the head unit 21 can be treated as a single nozzle column.

An irradiation device 80 is furnished with an ultraviolet light source (not shown), so the irradiation device is fixed to the subcarriage 28 or the unit plate 23 with the ultraviolet light source facing downward. An irradiation device 80 is arranged on both sides of the ejecting head 20 in the X-axis direction as mentioned above. In this way, the ultraviolet-curable ink landing on the recording medium 10 can be irradiated with ultraviolet light immediately after the ultraviolet-curable ink has been ejected from the ejecting head 20 to the recording medium 10. In other words, the ejecting head 20 ejects ultraviolet-curable ink while scanning in the X-axis direction (main scanning direction). Therefore, because the recording medium 10 is irradiated with ultraviolet light by the irradiation device 80 positioned to the rear in the direction of movement when the unit plate 23 is scanning in the X-axis direction, the ultraviolet-curable ink landing on the recording medium 10 can be irradiated with ultraviolet light.

Here, a metal halide lamp, xenon lamp, carbon arc lamp, chemical lamp, low-pressure mercury lamp, or high-pressure mercury lamp can be used as the ultraviolet light source. LEDs emitting light in the ultraviolet range can also be used.

An ultraviolet-curable ink cured by ultraviolet light from an ultraviolet light source can be formulated by adding auxiliary agents such as defoamers and polymerization inhibitors to a mixture of a vehicle, photopolymerization initiator, and pigment. The vehicle is formulated by adjusting the viscosity of an oligomer or monomer having photopolymerization curability using a reactive diluent. Thus, a solvent is not evaporated to cure the ink.

The vehicle can be a monofunctional or polyfunctional polymerizable compound. Specific examples include oligomers (prepolymers) such as polyester acrylate, epoxy acrylate, and urethane acrylate. A reactive diluent can be used with these materials to adjust the viscosity of the ink.

As a photopolymerization initiator, benzophenones, benzoins, acetophenones, and thioxanthones are widely used. Specific examples include the use of water-soluble organic compounds of quaternary ammonium salts, such as 4-benzoyl-N,N,N-trimethyl benzene methane ammonium chloride, 2-hydroxy-3-(4-benzoyl-phenoxy)-N,N,N-trimethyl-1-propane ammonium chloride, and 4-benzoyl-N,N-dimethyl-N-[2-(1-oxo-2-propenyloxy)ethyl]benzene methammonium bromide. Because these photopolymerization initiators have different ultraviolet absorption characteristics, reaction starting efficiency, and yellowing characteristics depending on the composition, they can be used selectively depending on the color of the ink.

Any compound that has radical scavenging ability and can inhibit radical polymerization can be used as a polymerization inhibitor. When taking into account ejecting suitability for an inkjet recording device, one or more type of compound selected from among hydroquinones, catechols, hindered amines, phenols, phenothiazines, and quinones with fused aromatic rings is preferred.

Examples of hydroquinones include hydroquinone, hydroquinone monomethyl ether, 1-o-2,3,5-trimethyl hydroquinone, and 2-tert-butyl hydroquinone. Examples of catechols include catechol, 4-methyl catechol, and 4-tert-butyl catechol. Hindered amines include compounds with a tetramethyl piperidinyl group.

Examples of phenols include phenol, butylhydroxy toluene, butylhydroxyanisole, pyrogallol, gallic acid, and gallic acid alkyl esters. An example of a phenothiazine is phenothiazine. An example of a quinone with a fused aromatic ring is naphthoquinone.

The polymerization inhibitor can be carbon black, or inorganic or organic particles on whose surfaces have been introduced a polymerization inhibiting functional group. Examples of polymerization inhibiting functional groups include a hydroxyphenyl group, dihydroxyphenyl group, tetramethyl piperidinyl group, and fused aromatic ring.

The ultraviolet-curable ink can be a color ink containing a coloring material (coloring component) such as a pigment or dye. However, it can also be a clear ink for providing an undercoat or overcoat. In addition to a coloring material, a white ink or a black ink can also be used to provide an overcoat.

Figure 5:
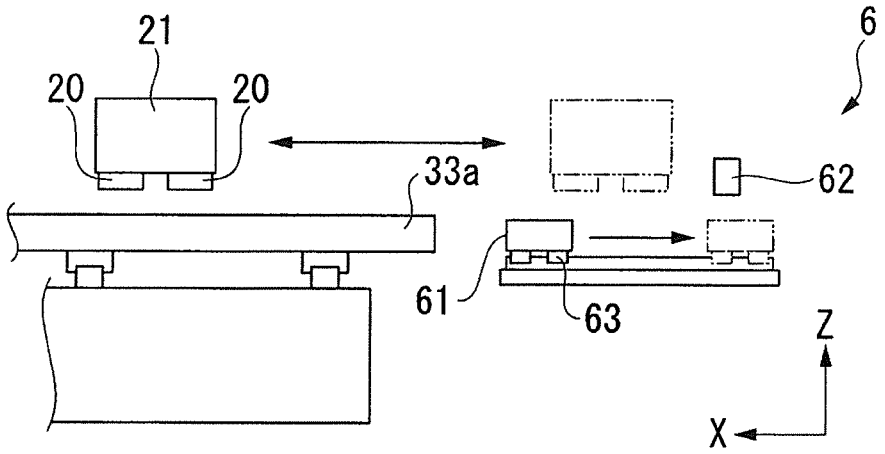
FIG. 5 is a schematic view including the inspection unit 6 of the liquid droplet ejecting apparatus in the first embodiment of the present invention.

The following is an explanation with reference to FIG. 5 of the inspection unit 6. FIG. 5 is a schematic side view including the inspection unit 6 as viewed from the +Y direction of FIG. 1.

The inspection unit 6 is used to inspect the ink ejecting state of the nozzles 24. More specifically, the inspection unit primarily detects missing dots that occur because ink has not been ejected from a nozzle 24.

As shown in FIG. 5, the inspection unit 6 includes an inspection ejection unit 61 and a scanner for inspection 62 (imaging unit).

Ink is ejected from the nozzles 24 of the ejecting head 20 onto the inspection ejection unit 61 for inspection. The inspection ejection unit 61 is arranged to one side of the vacuum-chucking table 33*a* in the X direction.

The inspection unit for inspection 61 includes a flexible film whose surface is the ink ejecting region, a winding device for winding a region of the flexible film onto which ink has been ejected, and a supply device for supplying a region of the flexible film onto which ink has not been ejected.

The flexible film is set so the width of the exposure region (region in which ink can be ejected) is several times the width of the ejecting head 20, and the length of the exposure region is the same as that of the head unit 21.

In other words, because the ink ejected from each of the ejecting heads 20 arranged in a staggered manner in the Y direction can be arranged linearly for each nozzle column 24*a*, in the inspection ejection unit 61, and because the inspection ejection unit 61 can be displaced in the X direction, the operation for ejecting ink from all of the nozzles 24 can be repeatedly performed a plurality of times.

Flexible film made of polyethylene terephthalate (PET), polyethylene (PE), polycarbonate (PC), or polypropylene (PP) can be used as the flexible film.

The inspection ejection unit 61, as shown in FIG. 5, can be moved horizontally by a sliding device 63 able to move in the X direction.

In the present embodiment, the sliding device 63 can move the inspection ejection unit 61 from a position below the ejecting head 20 to a position below the inspection scanner 62.

The inspection scanner 62 is arranged farther away from the vacuum-chucking table 33*a* than the inspection ejection unit 61 in the X direction, and is fixed outside of the movable range of the ejecting head 20 (head unit 21).

The inspection scanner 62 images the ink ejected onto the inspection ejection unit 61 in a region outside of the movable range of the ejecting head 20.

In the liquid droplet ejecting apparatus 1 of this embodiment, the inspection ejection unit 61 can move horizontally, and the inspection scanner 62 is fixed.

Ink is ejected from the ejecting head 20 onto the inspection ejection unit 61 arranged below the ejecting head 20, and then the inspection ejection unit 61 is moved to a position below the imaging scanner 62 and the ejected ink is imaged.

Returning to FIG. 1, the control unit 60 controls all of the operations of the liquid droplet ejecting apparatus 1 in the present embodiment. For example, the control unit 60 controls the X-axis scanning mechanism 11 to perform the main scanning in the X-axis direction, and controls the Y-axis scanning mechanism 42 to perform the subscanning in the Y-axis direction. The main scanning control is performed by controlling the X-axis scanning mechanism 11 and the Y-axis scanning mechanism 42, and ejecting is controlled from the nozzles 24 (nozzle columns 70) in each direction. In other words, the control unit functions as an ejecting control unit for controlling the ejecting process in each direction.

In the liquid droplet ejecting apparatus 1 in the present embodiment, the control unit 60 performs controls to eject ink from the nozzles 24 onto the recording medium 10 while repeatedly moving the ejecting head 20 forward and backward in the main scanning direction. It also performs controls to eject ink from the nozzles 24 onto the inspection ejection unit 61 during the first forward movement.

Also, the control unit 60 performs a control to displace the placement position underneath the ejecting head 20 each time ink is ejected from the nozzles 24.

Figure 6:
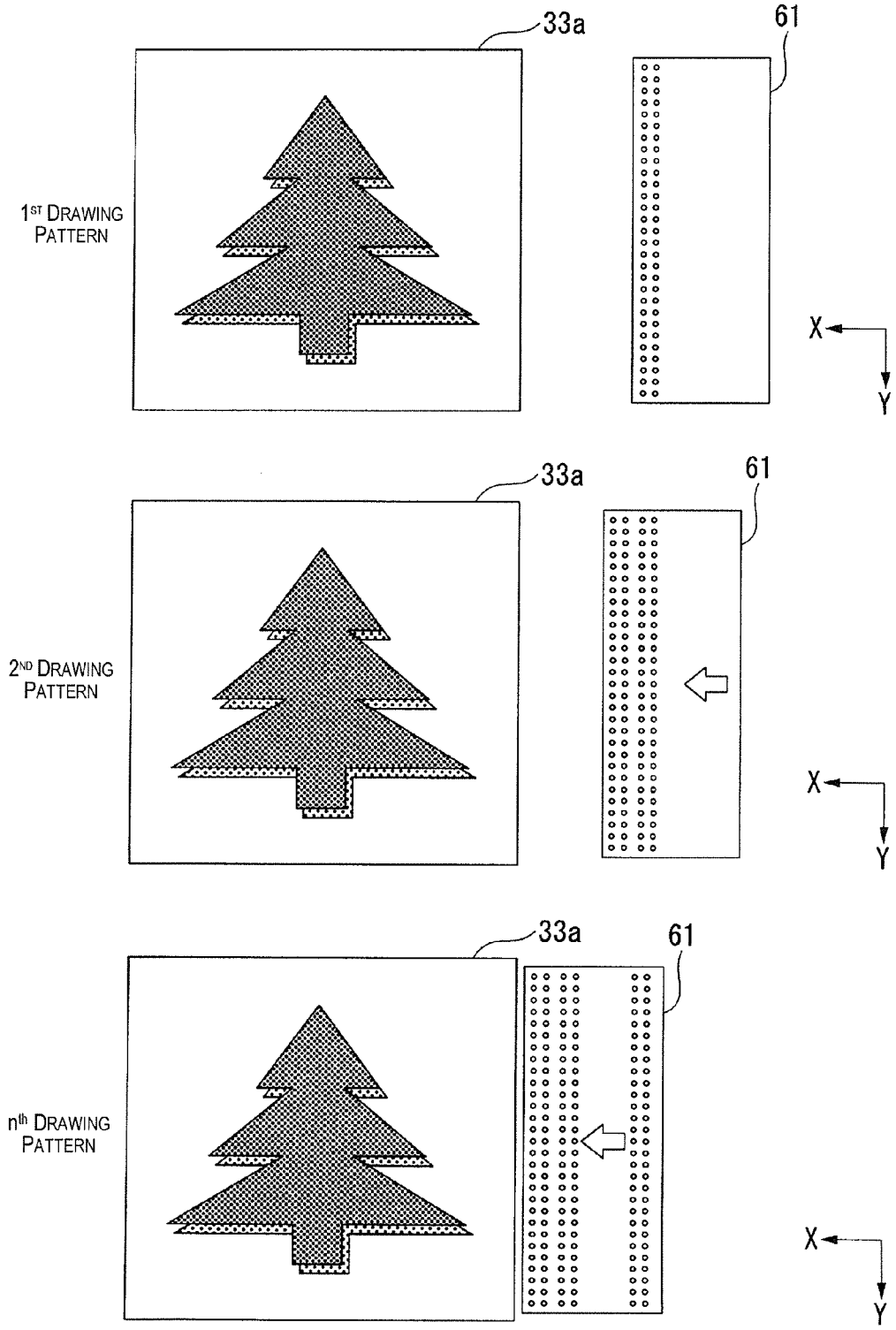
FIG. 6 is a schematic view illustrating how the position of the inspection ejection unit is displaced.

In the present embodiment, ink is ejected from the nozzles 24 onto the inspection ejection unit 61 during the first forward movement while a first drawn image is being formed. For this reason, as shown in FIG. 6, in a case in which a missing dot is not detected, the position of the inspection ejection unit 61 is displaced in the X direction for each drawn pattern. Here, the amount of displacement is set so that subsequently ejected ink does not overlap with previously ejected ink.

In a case in which a missing dot is detected, the position of the inspection ejection unit 61 is displaced in the X direction even while a drawing pattern is being drawn so that inspection ejecting can be performed again as described below.

The control unit 60 determines whether or not a nozzle 24 has a missing dot on the basis of image data obtained from the inspection scanner 62. In a case in which there is a missing dot, it is determined that a nozzle 24 with an abnormal ink ejecting state is the cause of the missing dot.

In a liquid droplet ejecting apparatus 1 with this configuration, ink is ejected onto the recording medium 10. In printing the desired image, the control unit 60 first drives the X-axis drive motor for the X-axis scanning mechanism 11 and the Y-axis drive motor for the Y-axis scanning mechanism 42, and the relative position of the recording medium 10 is successively changed relative to the ejecting head 20 and the vacuum-chucking table 33*a*. These scanning controls are performed concurrently, a drive waveform (drive voltage) is applied to piezoelectric elements 59 in the ejecting head 20, and ultraviolet-curable ink is ejected from each nozzle column 70 in the ejecting head 20 onto the recording medium 10 where the droplets land.

Here, the operation of the liquid droplet ejecting apparatus 1 when a single drawn pattern is formed will be described in detail with reference to the flowchart in FIG. 7.

In this operation, the inspection ejection unit 61 is arranged in a position where ink can be ejected from the ejecting head 20, and an image can be formed (ejecting ink onto the recording medium 10).

Figure 7:
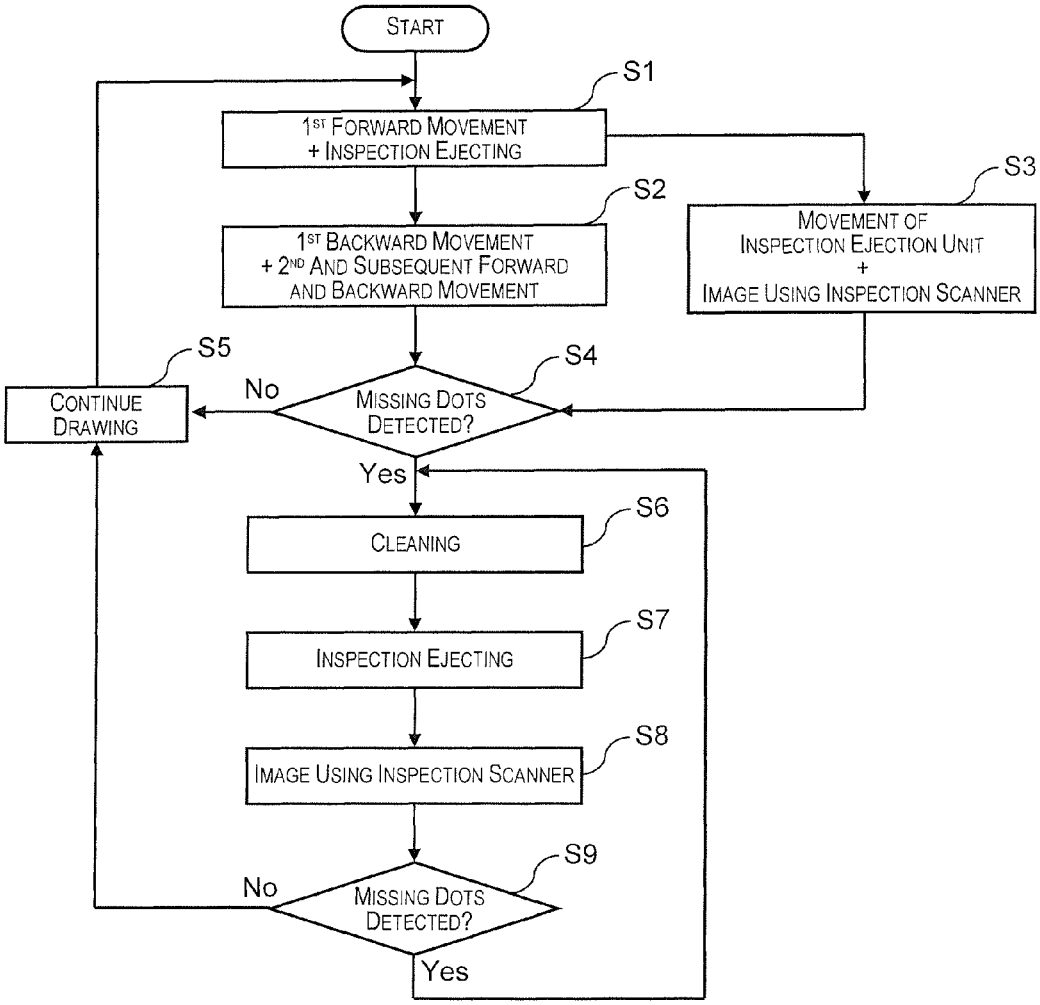
FIG. 7 is a flowchart used to explain the operation of the liquid droplet ejecting apparatus in the first embodiment of the present invention.

As shown in FIG. 7, when the ejecting head 20 moves forward the first time, inspection ejecting is performed by ejecting ink from the nozzles 24 onto the inspection ejection unit 61 (Step S1).

Afterwards, concurrent with the backward movement of the ejecting head 20 and the second and subsequent forward and backward movements are performed concurrently (Step S2), and then the inspection ejection unit 61 is moved and imaged by the inspection scanner 62 (Step S3).

In a case in which a missing dot has not been detected (Step S4), drawing continues (Step S5). In a case in which a missing dot has been detected (Step S4), drawing is stopped, and the ejecting head 20 is then cleaned using the maintenance unit 5 (Step S6). After the inspection ejection unit 61 has been arranged in a position where ink can be ejected from the ejecting head 20, inspection ejecting is performed again (Step S7). Imaging is performed using the inspection scanner 62 (Step S8), and it is determined whether or not there is a missing dot (Step S9).

In the liquid droplet ejecting apparatus 1 (liquid droplet ejecting method) in the present embodiment, the inspection scanner 62 is arranged outside of the movable range of the ejecting head 20, and the inspection ejection unit 61 is configured so as to be able to move.

As a result, after ink has been ejected onto the inspection ejection unit 61 below the ejecting head 20, the inspection ejection unit 61 is moved, and the ejected ink is imaged by the inspection scanner 62. Here, the inspection scanner 62 does not have to move in the movable range of the ejecting head 20.

Therefore, in the liquid droplet ejecting apparatus 1 in the present embodiment, the ejecting head 20 can be moved when the nozzle ejecting state is inspected, and ink can be ejected onto the recording medium 10 and the nozzle ejecting state can be inspected concurrently.

Thus, the liquid droplet ejecting apparatus 1 in the embodiment can improve printing quality while preventing a decrease in printing speed.

Also, in the liquid droplet ejecting apparatus 1 in the embodiment, the inspection ejection unit 61 can move horizontally, and the inspection scanner 62 is fixed.

For this reason, the inspection scanner 62 can perform imaging simply through having the inspection ejection unit 61 moved horizontally.

In other words, the inspection ejection unit 61 can be moved along a single axis, and the moving mechanism for the inspection unit (the sliding device 63 in the present embodiment) can be simplified.

Also, in the liquid droplet ejecting apparatus 1 in the present embodiment, a control is performed to eject ink from the nozzles 24 onto the recording medium 10 while the ejecting head 20 is moved forward and backward repeatedly in the main scanning direction, and ink is ejected from the nozzles 24 onto the inspection ejection unit 61 during the first forward movement.

As a result, the liquid droplet ejecting apparatus 1 in the present embodiment can inspect the ink ejecting state according to the quickest timing while a single drawn pattern is printed.

Therefore, in a case in which there is an abnormality in the ink ejecting state, the ejecting of ink onto the recording medium 10 can be stopped according to the quickest timing, and the amount of ink consumed can be reduced.

Also, in the liquid droplet ejecting apparatus 1 in the present embodiment, the position in which the inspection ejection unit 61 is arranged beneath the ejecting head 20 can be displaced each time ink is ejected from the nozzles 24.

As a result, the ink ejecting positions on the inspection ejection unit 61 can be displaced without changing the bit map data. This prevents a significant increase in operating costs due to the changing the bit map data.

In the present embodiment, the inspection ejection unit 61 can move horizontally, and the inspection scanner 62 is fixed.

Figure 8:
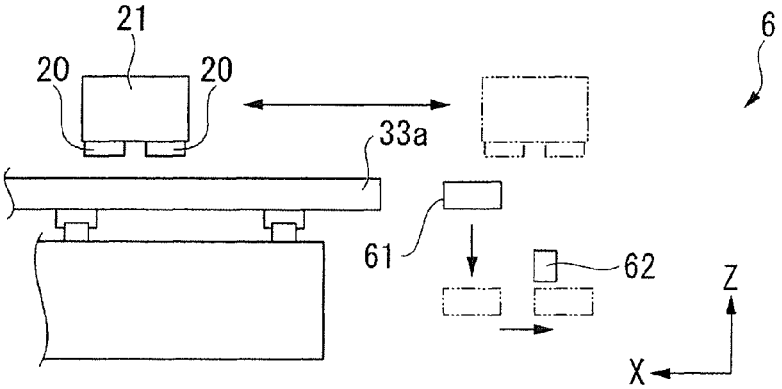
FIG. 8 is a schematic view of a modification of the liquid droplet ejecting apparatus in the first embodiment of the present invention.

However, as shown in FIG. 8, the inspection ejection unit 61 can be configured to move vertically, and the inspection scanner 62 can be fixed. Also, as shown in FIG. 9, the inspection ejection unit 61 can be configured to move both vertically and horizontally, and the inspection scanner 62 can be configured to move horizontally.

In other words, the inspection ejection unit 61 can be configured to move at least vertically, and either the inspection ejection unit 61 or the inspection scanner 62 can be configured to move horizontally.

When these configurations are employed, as shown in FIG. 8 and FIG. 9, the inspection scanner 62 can be shifted vertically and arranged outside of the movable range of the ejecting head 20. As a result, printing quality can be improved while suppressing the decrease in printing speed and without increasing the size of the liquid droplet ejecting apparatus 1 as viewed from above.

Also, in the present embodiment, the inspection ejection unit 61 can be configured to move horizontally, and the inspection scanner 62 can be fixed farther to one side from the vacuum-chucking table 33*a* than the inspection ejection unit 61 in the X direction.

However, as shown in FIG. 10, the inspection scanner 62 can also be fixed farther to one side than the inspection ejection unit 61 in the Y direction.

Alternatively, as shown in FIG. 11, an idler roller 66 can be interposed between the winding device 64 for winding a region of the flexible film and the medium feed roller 65, and a region can be provided for transporting the flexible film in the Z-axis direction. Also, the inspection scanner 62 can be arranged in the region provided for transporting the flexible film in the Z-axis direction.

In this case, the inspection scanner 62 can be fixed or can be allowed to move in the Z-axis direction. When arranged to move in the Z-axis direction, the flexible film is moved so the inspection region is positioned between the medium feed roller and the idler roller. The inspection scanner 62 is then moved in the Z-axis direction and reading is performed using the inspection scanner 62. When such a configuration is adopted, the ejecting head 20 can be moved while the nozzle ejecting state is inspected, and the ejecting of ink onto the recording medium 10 and the inspection of the nozzle ejecting state can be performed concurrently. As a result, the printing quality can be improved while preventing a decrease in printing speed.

Also, in the present embodiment, the inspection ejection unit 61 can be configured so as to move horizontally in the X-axis direction, and the inspection scanner 62 can be configured so as to be fixed on one side farther away from the vacuum-chucking table 33*a* than the inspection ejection unit 61 in the X direction.

However, as shown in FIG. 12, a configuration can be adopted in which the inspection ejection unit 61 is configured so as to be moved horizontally in the Y-axis direction by the Y-axis direction moving device 67, and the inspection scanner 62 is configured so as to be fixed on one side farther away from the vacuum-chucking table 33*a* than the inspection ejection unit 61 in the Y-axis direction. When such a configuration is adopted, the ejecting head 20 can be moved while the nozzle ejecting state is inspected, and the ejecting of ink onto the recording medium 10 and the inspection of the nozzle ejecting states can be performed concurrently. As a result, the printing quality can be improved while preventing a decrease in printing speed.

Also, in the present embodiment, controls can be performed to eject ink from the nozzles 24 onto the inspection ejection unit 61 when the ejecting head 20 is moving in the first forward movement while a drawing pattern is being formed.

However, a control can be performed to eject ink from the nozzles 24 onto the inspection ejection unit 61 during consecutive forward and backward movements, and a control can also be performed to eject ink from the nozzle 24 onto the inspection ejection unit 61 when a plurality of forward and backward movements are performed.

For example, in a case in which control is performed to eject ink from the nozzles 24 onto the inspection ejection unit 61 during consecutive forward and backward movements, ink is ejected twice onto the inspection ejection unit 61, and the ink ejecting state for a single nozzle 24 can be determined from ink ejected in two spots.

Therefore, false detection of ink ejecting states caused, for example, by foreign matter adhering to the inspection ejection unit 61 can be suppressed, and accurate detection of the ink ejecting states can be realized.

For example, in a case in which control is performed to eject ink from the nozzles 24 onto the inspection ejection unit 61 during a plurality of forward and backward movements, ink is ejected a plurality of times onto the inspection ejection unit 61, and the ink ejecting states for a single nozzle 24 can be determined from ink ejected in a plurality of spots.

Therefore, false detection of ink ejecting states caused, for example, by foreign matter adhering to the inspection ejection unit 61 can be suppressed, and accurate detection of the ink ejecting states can be realized.

Also, instead of a configuration in which control is performed to eject ink from nozzles 24 onto the inspection ejection unit 61 during the first forward movement of the ejecting head 20 when a drawing pattern is formed, a configuration can be used in which a control is performed to move the ejecting head 20 before a drawing pattern is formed, ultraviolet-curable ink is ejected onto the inspection ejection unit 61, the ink ejecting state is inspected, the absence of missing dots is confirmed, and printing is performed.

Here, in a case in which a missing dot is detected, the drawn image is formed after the ejecting head 20 has been cleaned using the maintenance unit 5. While the printing speed does not decrease relative to the embodiment, a drawing pattern can be formed using an ejecting head 20 in which a nozzle is blocked, and the wasting of recording medium 10 can be prevented.

Also, in a case in which the ink ejecting states are inspected before a drawing pattern is formed, control can be performed to eject ink from the nozzles 24 onto the inspection ejection unit 61 during movement of the ejecting head 20 while a prior drawing pattern is being formed so that the inspection is completed while the recording medium 10 is being advanced before forming the next drawing pattern.

Because the inspection can be completed while the recording medium 10 is being advanced before forming the next drawing pattern, the printing time is no longer than the printing time of the embodiment and the ink ejecting states can be inspected before a drawing pattern is formed.

In a case in which a prior drawing pattern (first drawing pattern) is formed on the recording medium 10, the recording medium 10 is transported in the subscanning direction (the travelling direction of the target object) by the feed/discharge mechanism 3, and a subsequent drawing pattern (second drawing pattern) is formed on the recording medium 10 after transport, a control can be performed to eject ultraviolet-curable ink from the nozzles 24 to the inspection ejection unit 61 while the ejecting head 20 is repeatedly moving forward and backward in the main scanning direction to form the previous drawing pattern on the recording medium 10 so that the inspection of the ink ejecting states is completed before the subsequent drawing pattern is formed.

In this way, the ink ejecting state can be inspected before the subsequent drawing pattern is formed, and the printing quality of the subsequent drawing pattern can be improved.

Also, in the present embodiment, in a case in which a missing dot is detected, control is performed to stop the drawing immediately, and clean the ejecting head 20 using the maintenance unit 5.

However, in a case in which a missing dot is detected, control can be performed to clean the nozzles 24 after a drawing pattern has been completed, or control can be performed to confirm the usage frequency of a nozzle 24 in which an abnormality has been detected, and the start timing for cleaning the nozzle 24 can be decided in accordance with the usage frequency.

For example, in a case in which a missing dot has been detected and control is performed to clean the nozzles 24 after drawing of a drawing pattern has been completed, ink is ejected onto the recording medium 10 until the drawn pattern has been completed on this timing, even in a case in which an abnormality has been detected in the nozzle ejecting state.

Often, there is a possibility that an abnormal nozzle ejecting state will not lead to deterioration in printing quality within an allowable limit. Thus, in the present invention employing this configuration, the possibility that a pattern unnecessarily will be determined to be poor is reduced. As a result, improved yield may be realized.

For example, in a case in which a missing dot has been detected and control is performed to confirm the usage frequency of the nozzle 24 in which an abnormality has been detected and to decide the start timing for cleaning the nozzle 24 in accordance with the usage frequency, the start timing for the cleaning can be delayed on the basis of the usage frequency of the nozzle 24 in which an abnormality has been detected.

When the usage frequency of a nozzle 24 detected to be abnormal is very low, the impact of the nozzle on the product quality of a pattern drawn on a target material 10 may be negligible. In these cases, the present invention can delay the start timing of the cleaning process, thereby suppressing the occurrence of waiting time and improving printing speed.

Second Embodiment

Next, a second embodiment of the present invention will be described. In this description, components similar to those in the first embodiment are either described simply or not at all.

Figure 13:
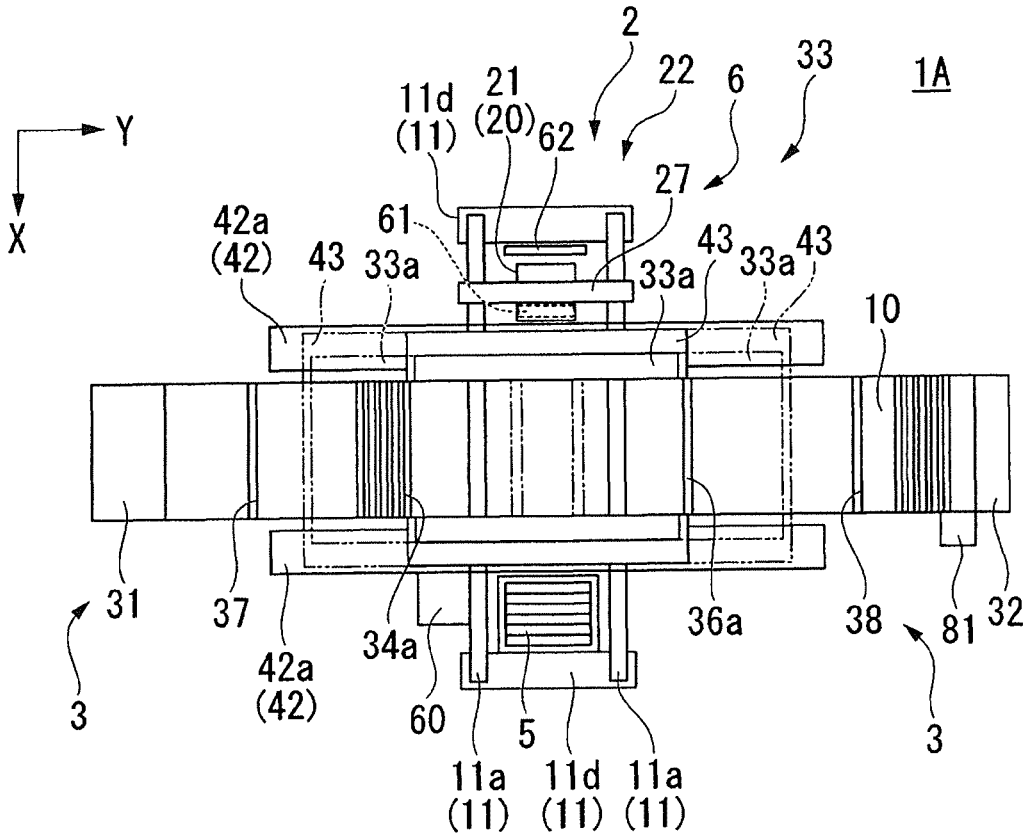
FIG. 13 is a top view schematically illustrating the configuration of the liquid droplet ejecting apparatus in the second embodiment of the present invention.

FIG. 13 is a top view schematically illustrating the configuration of the liquid droplet ejecting apparatus 1A in the second embodiment of the present invention.

As shown in FIG. 10, the liquid droplet ejecting apparatus 1A in the present embodiment is equipped with a marking unit 81 for marking an edge of a recording medium 10.

When the marking unit 81 is arranged near the take-up reel 32, and an abnormality has been detected by the inspection unit 6 in the ink ejecting state of a nozzle 24, the edge of the recording medium 10 is marked correspondingly with respect to the region in which ink was ejected from the nozzle 24 in which an abnormality was detected.

The marking unit 81 makes a mark on the outside (that is, on the edge) of the region in which a drawing pattern is formed on the recording medium 10 in order to avoid affecting the drawing pattern. However, marking can be performed in the entire region, or marking can be performed at the start point and end point of a region.

Because marking is performed by the liquid droplet ejecting apparatus 1A in the present embodiment to indicate a region in which ink has been ejected from a nozzle 24 determined to have an abnormal ink ejecting state, a region in which the possibility of failure is high later in the process can be known in advance, and the inspection, for example, can be focused on this region. As a result, printing quality can be more accurately determined.

The liquid droplet ejecting apparatus 1A in the present embodiment was equipped with a marking unit 81 to mark an edge of the recording medium 10. However, the ejecting head 20 can also be controlled to mark the edge of the recording medium 10 using a nozzle 24 in which an abnormality was not detected to indicate a region in which ink has been ejected from a nozzle 24 in which an abnormality has been detected. In this way, as well, a region in which the possibility of failure is high later in the process can be known in advance, and the inspection, for example, can be focused on this region. As a result, printing quality can be more accurately determined.

Third Embodiment

Next, a third embodiment of the present invention will be described. In this description, components similar to those in the first embodiment are either described simply or not at all.

Figure 14:
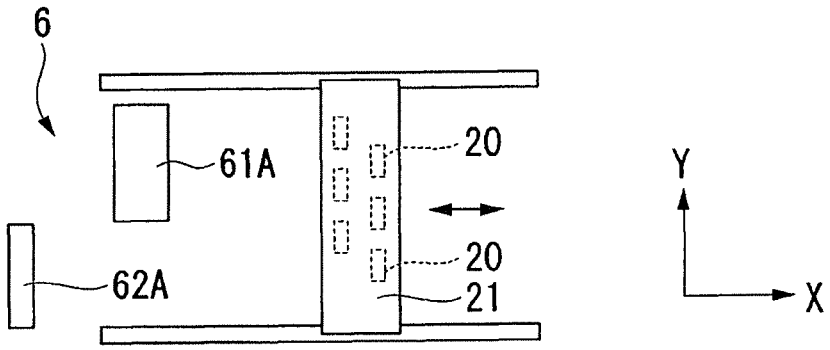
FIG. 14 is a top view schematically illustrating the inspection ejection unit and the inspection scanner in the liquid droplet ejecting apparatus in the third embodiment of the present invention.

FIG. 14 is a top view schematically illustrating the inspection ejection unit 61A and the inspection scanner 62A in the liquid droplet ejecting apparatus in the third embodiment of the present invention.

As shown, the length of both the inspection ejection unit 61A and the inspection scanner 62A in the liquid droplet ejecting apparatus in the present embodiment is half that of the head unit 21.

Even in a case in which such a configuration is adopted, the inspection ejection unit 61A in the liquid droplet ejecting apparatus of this embodiment can move. As a result, movement of the inspection ejection unit 61A allows ink to be ejected onto the inspection ejection unit 61A from all of the nozzles 24, and the ejected ink can be imaged using the inspection scanner 61B.

In a liquid droplet ejecting apparatus of this embodiment adopting such a configuration, the length of the inspection scanner 61B is shorter than the head unit 21. Compared to a case in which the inspection scanner is the same length as the head unit 21, the cost of the device can be reduced.

Preferred embodiments of the present invention have been described with reference to the appended drawings, but the present invention is not limited to these embodiments. The various configurations and combinations of components in the embodiments are given by way of example, and various modifications based on the design requirements can be realized within a range that does not depart from the spirit of the present invention.

For example, in the embodiments, the liquid droplet ejecting apparatus of the present invention was applied to a printing apparatus for printing a long, continuous printing medium. However, the present invention is not limited to this. For example, the target object can be a short, rectangular substrate. This substrate can be a glass substrate rather than the resin described above.

Also, in the embodiments, the irradiating device 80 is fixed to the subcarriage 28 or the unit plate 23, and is applied to a serial printing apparatus in which the head unit 21 is scanned in the X-axis direction by an X-axis scanning mechanism 11. However, the present invention is not limited to this. For example, a head carriage or so-called line head can be used in which the length of the head carriage is greater than the length of the recording medium 10 in the width direction of the printing region. Also, a so-called linear irradiation device can be used whose width is greater than that of the recording medium 10.

The present invention can also be applied to a liquid droplet ejecting apparatus not equipped with an irradiation device 80. In this case, the ejected ink does not have to be an ultraviolet-curable ink.

In the description of the embodiments, the present invention was applied to a liquid droplet ejecting apparatus primarily for industrial application. However, the present invention can also be applied to a printer for consumer applications.

In the description of the embodiments, the entire inspection ejection unit could be moved.

However, the present invention is not limited to this. For example, the present invention could be configured so that only the flexible film in the inspection ejection unit moves (runs). In such a case, as long as the region on which ink has been ejected can be moved and the region can be moved to an inspection camera, printing quality can be improved while preventing a decrease in printing speed in a manner similar to the embodiments described above.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid droplet ejecting apparatus comprising:

an ejecting head having a nozzle that ejects ink onto a target object, the ejecting head being configured and arranged to move between first and second positions along a first axis of the liquid droplet ejecting apparatus relative to the target object; and an inspection unit configured and arranged to inspect an ink ejecting state of the nozzle, the inspection unit including an inspection ejection unit onto which the ink is ejected from the nozzle of the ejecting head while the ejecting head being located at the second position, the inspection ejection unit being movable, and an imaging unit disposed in a direction directing from the first position to the second position along the first axis relative to the second position such that the imaging unit is arranged in a region outside of a movable range of the ejecting head on the first axis, the imaging unit being configured and arranged to image the ink ejected onto the inspection ejection unit in the region outside of the movable range of the ejecting head.

2. The liquid droplet ejecting apparatus according to claim 1, wherein the inspection ejection unit is configured and arranged to move horizontally, and the imaging unit is fixed.

3. The liquid droplet ejecting apparatus according to claim wherein a control is performed to eject the ink from the nozzle onto the target object while the ejecting head repeatedly moves forward and backward along the first axis, and to eject the ink from the nozzle onto the inspection ejection unit during a first forward movement.

4. The liquid droplet ejecting apparatus according to claim 1, wherein a control is performed to eject the ink from the nozzle onto the target object while the ejecting head repeatedly moves forward and backward along the first axis, and to eject the ink from the nozzle onto the inspection ejection unit during consecutive forward and backward movements.

5. The liquid droplet ejecting apparatus according to claim 1, wherein a control is performed to eject the ink from the nozzle onto the target object while the ejecting head repeatedly moves forward and backward along the first axis, and to eject the ink from the nozzle onto the inspection ejection unit during a plurality of forward and backward movements.

6. The liquid droplet ejecting apparatus according to claim 1, further comprising a feed/discharge mechanism configured and arranged to transport the target object in a feed direction of the target object, wherein when a second drawing pattern has been formed on the target object after the target object has been transported in the feed direction of the target object using the feed/discharge mechanism after a first drawing pattern has been formed on the target object, a control is performed to eject the ink from the nozzle onto the inspection ejection unit during one of forward and backward movements of the ejecting head, which is repeatedly moved forward and backward along the first axis to form the first drawing pattern on the target object, so as to complete inspection before formation of the second drawing pattern begins.

7. The liquid droplet ejecting apparatus according to claim 1, further comprising a marking unit configured and arranged to, when an abnormality in the ink ejecting state of the nozzle has been detected by the inspection unit, create a mark indicating a region to which the ink is ejected from the nozzle that has been detected as abnormal.

8. The liquid droplet ejecting apparatus according to claim 1, wherein when an abnormality in the ink ejecting state of the nozzle has been detected by the inspection unit, a control is performed to clean the nozzle after a pattern drawn by ejecting the ink has finished being drawn.

9. The liquid droplet ejecting apparatus according to claim 1, wherein when an abnormality in the ink ejecting state of the nozzle has been detected by the inspection unit, a control is performed to confirm a usage frequency of the nozzle that has been detected as abnormal and to decide a start timing for cleaning the nozzle in accordance with the usage frequency.

10. The liquid droplet ejecting apparatus according to claim 1, wherein a length of the imaging unit is shorter than a length of a head unit to which a plurality of the ejecting heads are provided.

11. The liquid droplet ejecting apparatus according to claim 1, wherein a control is performed so that, each time the ink is ejected from the nozzle, a position of the inspection ejection unit below the ejecting head is displaced.

12. A liquid droplet ejecting apparatus comprising:

an ejecting head having a nozzle that ejects ink onto a target object, the ejecting head being configured and arranged to move relative to the target object; and an inspection unit configured and arranged to inspect an ink ejecting state of the nozzle, the inspection unit including an inspection ejection unit onto which the ink is ejected from the nozzle of the ejecting head, the inspection ejection unit being movable, and an imaging unit arranged in a region outside of a movable range of the ejecting head, the imaging unit being configured and arranged to image the ink ejected onto the inspection ejection unit in the region outside of the movable range of the ejecting head, the inspection ejection unit being configured and arranged to move at least vertically between third and fourth positions, one of the inspection ejection unit and the imaging unit being configured and arranged to move horizontally, and the imaging unit being disposed vertically between the third and fourth positions.

13. A liquid droplet ejecting method for ejecting ink onto a target object from a nozzle formed in an ejecting head that is movable between first and second positions along a first axis of a liquid droplet ejecting apparatus relative to the target object, the liquid droplet ejecting method comprising:

ejecting the ink onto an inspection ejection unit from the nozzle in the ejecting head while the ejecting head being located at the second position;

moving the inspection ejection unit; and imaging the ink ejected onto the inspection ejection unit in a region outside of a movable range of the ejecting head to inspect the ink ejecting state of the nozzle by an imaging unit that is disposed in a direction directing from the first position to the second position along the first axis relative to the second position.

* * * * *